United States Patent [19]

Tomer

[11] 4,428,168

[45] Jan. 31, 1984

[54] PERMANENT FLORAL DECORATION

[76] Inventor: Rex F. Tomer, P.O. Box 75, Ewing, Ill. 62836

[21] Appl. No.: 326,382

[22] Filed: Dec. 1, 1981

[51] Int. Cl.[3] ..... E04H 13/00

[52] U.S. Cl. ..... 52/104; 428/13

[58] Field of Search ..... 428/13, 319.7; 52/169.11, 102, 103, 104, 105; 40/124.5; 264/257

[56] References Cited

U.S. PATENT DOCUMENTS

| | | | |
|---|---|---|---|
| 482,237 | 9/1892 | Follenius | 40/124.5 |
| 955,720 | 4/1910 | Thomas | 40/124.5 |
| 1,904,738 | 4/1933 | Johnson | 40/124.5 |
| 1,966,922 | 7/1934 | Coleman | 40/124.5 |
| 2,312,859 | 3/1943 | Zentmyer | 52/103 |
| 3,626,702 | 12/1971 | Monahan | 52/169.11 |
| 3,660,211 | 2/1972 | Brody | 428/13 |
| 4,081,579 | 3/1978 | Queen et al. | 428/319.7 |
| 4,176,210 | 11/1979 | Skinner | 428/319.7 |
| 4,209,486 | 6/1980 | Ross | 264/257 |

FOREIGN PATENT DOCUMENTS

| | | | |
|---|---|---|---|
| 1413870 | 12/1963 | France | 52/103 |

OTHER PUBLICATIONS

Boy's Life, Sep. 1976, p. 41.

*Primary Examiner*—James L. Ridgill, Jr.
*Attorney, Agent, or Firm*—Harvey B. Jacobson

[57] ABSTRACT

A permanent floral decoration for utilization on grave sites which in one embodiment includes a concrete container into which is positionable a hardenable resin having embedded flowers and the like. A layer of foam plastic is placed in the bottom of the concrete container before placing the resin therein to provide for expansion and contraction of the resin, as well as for insulation from cold, dampness, and the like, while a threshold or border is positionable along a top portion of the container and resin to prevent damage during lawn mowing activities and the like. In another embodiment, a mold constructed of fiberglass is used to form the hardenable resin with decorative items therein after which the hardened resin block is removed from the mold and placed into a ground cavity with a block of rigid foam plastic being placed in the bottom of the ground cavity. A threshold is attached to the block of hardened resin material and anchor members secure the block in place. Flowers, war medals, baby shoes, crosses, photos, and other objects may be embedded in the resin for both aesthetic appearance and in memory of a deceased person.

12 Claims, 6 Drawing Figures

FIG. 1
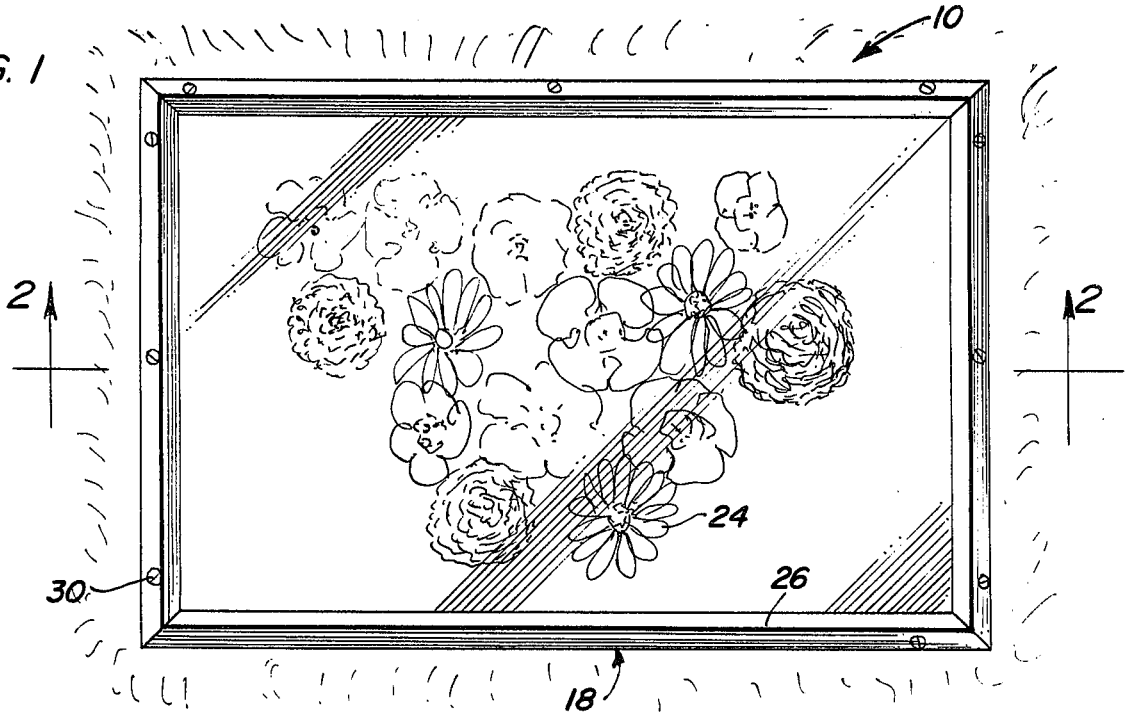
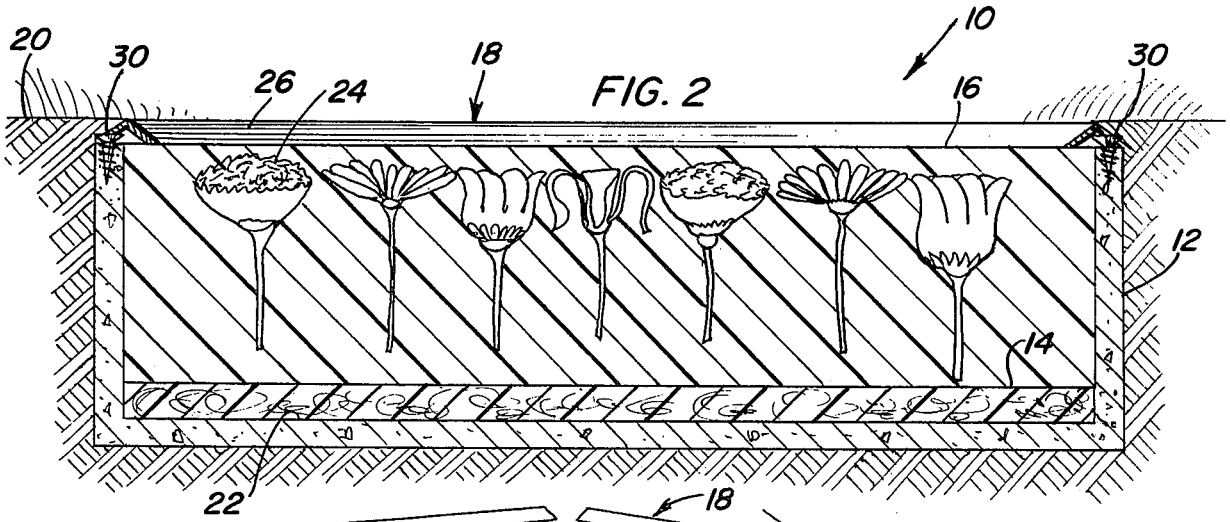
FIG. 2
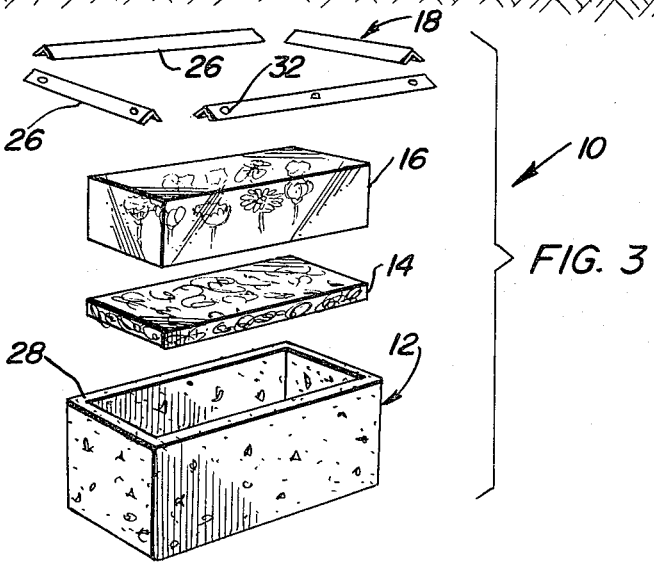
FIG. 3

PERMANENT FLORAL DECORATION

BACKGROUND OF THE INVENTION

1. Field of the Invention

The present invention relates generally to grave markers and more particularly pertains to a new and improved grave marker which includes flowers and other decorations and mementos embedded in a transparent hardened resin forming a part of a grave marker.

2. Description of the Prior Art

The use of transparent grave markers having various mementos and decorations viewable within or through the marker is well known in the art. In this respect, U.S. Pat. No. 945,721, issued to Ifft on Jan. 4, 1910, discloses a tombstone constructed of a transparent or translucent material, such as glass or the like, with an oblong compartment being positioned below the glass whereby flowers and the like may be permanently retained in the tombstone in a manner which permits a viewing of the same. Similarly, U.S. Pat. No. 2,812,102, issued to Caplinger on Nov. 5, 1957, discloses a grave marker of a transparent or translucent construction having a hollow chamber in which flowers in a preserved or semi-preserved state may be retained. A special gas-filled atmosphere is maintained within the chamber so as to give the flowers a long-lasting and non-fading quality.

More recently, U.S. Pat. No. 3,962,836, issued to Carnes et al on June 15, 1976, disclosed a grave marker for permanent mounting in a concrete slab, with a pan-shaped cover constructed of rigid transparent acrylic. Appropriate raised inscriptions may be positioned below the acrylic for a viewing therethrough, while the entire grave marker is designed to be positionable within the ground so as to be flush with the surface thereof. This patent, as well as the two aforediscussed patents, depends upon hollow chambers for the retention of appropriate inscriptions and the like, with transparent covers being utilized to view the inscriptions, mementos, etc.

At least one attempt has been made to construct a grave marker of a solid construction which utilizes a translucent or transparent material. In this respect, U.S. Pat. No. 4,054,000, issued to Lisle on Oct. 18, 1977, discloses a lawn marker comprising a solid member formed from translucent or transparent acrylic or methacrylic polymer, and having indicia indicative of or desired by the decedent embedded therein. In this respect, it is noted that flowers, religious medals, jewelry, hobby items, and the like, as well as other treasured mementos of a deceased person, may be contained within the lawn marker. Additionally, a layer of concrete may be placed below the marker as well as around the sides thereof to facilitate its retention within the ground. However, no means are provided for facilitating an expansion and contraction of the acrylic within the ground, nor are any insulation means provided to prevent weathering and cracking of the acrylic over an extended period of time. Additionally, the construction of the Lisle lawn marker is such that damage may result thereto during lawn mowing operations, inasmuch as no means are provided to protect the same from lawn mowers. Further, the Lisle lawn marker is subject to theft inasmuch as no permanent attachment between the acrylic portion of the marker and its concrete surrounding structure is disclosed.

Accordingly, it can be appreciated that there exists a continuing need for improved lawn markers which utilize transparent or translucent material having embedded mementos and decorations therein, which are resistant to the surrounding environment and which are appropriately protected from theft. In this connection, the present invention substantially fulfills this need.

SUMMARY OF THE INVENTION

The general purpose of the present invention, which will be described subsequently in greater detail, is to provide a new and improved lawn marker having embedded viewable mementos and decorations therein. In one embodiment, the invention utilizes a concrete container of a generally rectangular shape having a layer of rigid foam plastic, such as "Styrofoam" positioned in the bottom thereof and a layer of hardenable resin contained substantially within the concrete container and resting upon the layer of foam plastic. The hardenable resin has various mementos and other decorations contained therein and may be securely retained within the concrete container by the use of a topmost located metal threshold which overlaps the hardenable resin and which is fixedly securable to a topmost portion of the concrete container. In this respect, headless screws may be utilized to prevent a removal of the threshold or alternatively, the screws may be positioned in countersunk holes, which are then subsequently filled with a hardening material once the threshold has been attached to the concrete container. The foam plastic serves to insulate the hardenable resin, as well as to permit an expansion and contraction thereof within the concrete container in response to outside environmental temperature changes. In another embodiment, a fiberglass mold is provided with a gel coat after which a hardenable plastic is poured into the mold and decorations placed therein. After hardening, the block of resin is placed in a ground cavity having a layer of foam plastic in the bottom thereof and a threshold and anchors are attached thereto.

It is therefore an object of the present invention to provide a new and improved grave marker having viewable embedded mementos and decorations which may be easily and economically manufactured, is of a rugged and durable construction so as to be resistant to weathering and abrasive damage, which provides means for facilitating an expansion and contraction of such resin in response to environmental temperature changes, which utilizes theft prevention means in combination therewith and in one embodiment includes a concrete container and in another embodiment uses anchor members to retain the marker in place.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top plan view of the grave marker forming the present invention illustrating the same operably installed at a grave site.

FIG. 2 is a sectional elevation view taken along the line 2—2 in FIG. 1.

FIG. 3 is an exploded group perspective view of the present invention illustrating the various structural components associated therewith.

DESCRIPTION OF THE PREFERRED EMBODIMENT

Figure 4:
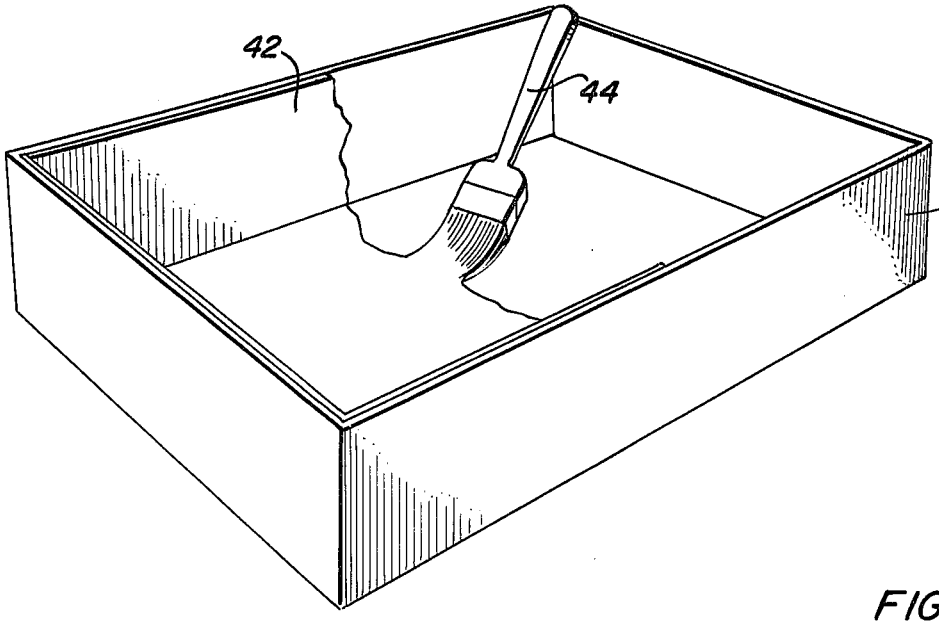
FIG. 4 is a perspective view illustrating a first step in forming a second embodiment of the invention.

With reference now to the drawings, a new and improved grave marker or permanent floral decoration embodying the principles and concepts of the present invention and generally designated by the reference numeral 10 will be described. In this respect, it can be seen that the grave marker 10 essentially consists of a rectangularly-shaped, box-like container 12, a layer of resilient insulating material 14, such as "Styrofoam" or the like, a section of transparent or translucent hardenable resin 16 and a retaining or securing means, such as threshold 18.

With respect to the box-like container 12, it is expected that the same will be constructed of light colored or white concrete, typically having a bottom portion and side walls which are one-half to one and one-half inches thick, and having an open top so as to permit the positioning of the foam plastic 14 and the translucent or transparent resin 16 therein. As clearly illustrated in FIG. 2, the container 12 is designed to be substantially positioned within a ground surface 20 whereby the same will be generally flush with the ground surface so that it will not interfere with lawn mowing and other grounds keeping operations.

As further illustrated in FIG. 2, the layer of resilient insulating foam plastic 14 is of a substantially conforming shape to the interior of the container 12 and is positionable along the bottom floor 22 associated therewith. Effectively, the foam plastic 14 serves as a base upon which the hardenable resin 16 may be positioned in the manner illustrated. The resin 16 is of a shape conforming to the interior shape of the container 12, and the foam plastic 14 in combination with the resin 16 serves to substantially fill the space defined by the interior of the container 12.

As to the construction of the hardenable resin 16, the same is of the commercially available type which is comprised of a normally liquid resin which may be selectively mixed with a catalyst to effect a desired hardening thereof. In this regard, the hardenable resin 16 may have various mementos and decorations embedded therein, such as flowers 24, with such mementos and decorations being positionable in the resin while it is still in its liquid form and after the hardening catylst has been added. Specifically, once the catalyst has been added to the liquid resin, a certain period of time is required before the resin 16 hardens, thus permitting the selective positioning of the various mementos and decorations within the resin prior to such hardening in a manner well known. In this connection, the mementos and decorations may include flowers, war medals, baby shoes, crosses, photographs, and virtually any other conceivable item that one might wish to have embedded within the resin.

Once the container 12 has the hardened resin 16 positioned therein, whereby the same rests substantially upon the layer of foam plastic 14, which typically might be one inch thick, the threshold 18 is assembled thereon. The threshold consists of a plurality of metal members 26 of angle iron having mitered corners, such members being positionable around a topmost edge 28 of the container 12 and being fixedly securable thereto by any conventional attachment means, such as by screws 30. In this respect, one leg of each member 26 is securable to the top edge 28 of the container 12, while the remaining leg of the member extends outwardly over the resin 16 to effectively retain the same within the container 12, while at the same time preventing its removal therefrom. To assure that the threshold 18 may not be removed from its secure attachment to the top edge 28 of the container 12, the screws 30 may be of a headless construction type or alternatively, the screws may be positioned within recessed apertures 32 associated with the threshold 18, such apertures then being fillable with a hardenable material once the screws have effected a desired attachment of the threshold to the container. Accordingly, such a construction will prevent a removal of the screws 30 from the container 12, thereby to prevent the attendant removal of the threshold 18 which in turn would permit a thief to remove the resin 16 from the container, thus to gain access to the mementos and other decorations contained within the resin.

In summary, the grave marker comprising the present invention may be constructed in various sizes, with the preferred basic sizes being 9"×16", 12"×19" and 15"×22". In addition to the preferred 1" thick layer of foam plastic contained within the container 12, it is expected that the permanent floral decoration formed formed from the resin 16 will be 2" to 4" thick while the threshold might be ¾" to 2" wide and of any desired color. If desired, the hardened resin may be buffed to assure a good, clear finish, while a protective coating may also be applied. Of course, various other materials might be employed in the construction of the invention. For example, plastic or plexiglass could be used in place of the hardenable resin, as could any other type of translucent or transparent material having some means or provision for embedding various items therein.

Figure 5:
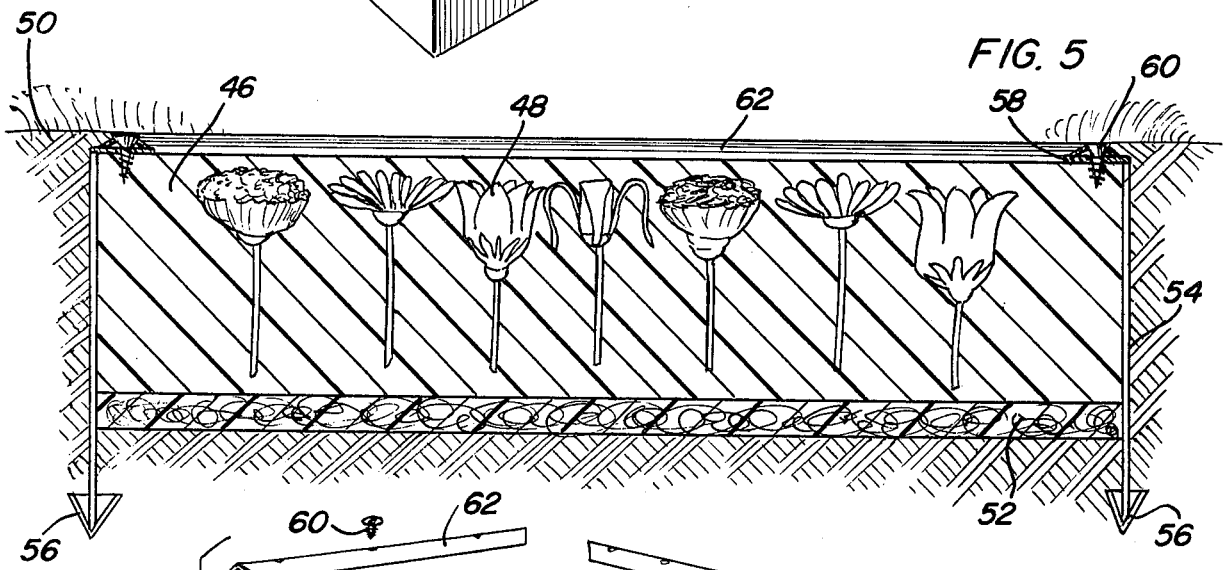
FIG. 5 is a sectional view of the second embodiment of the invention.
Figure 6:
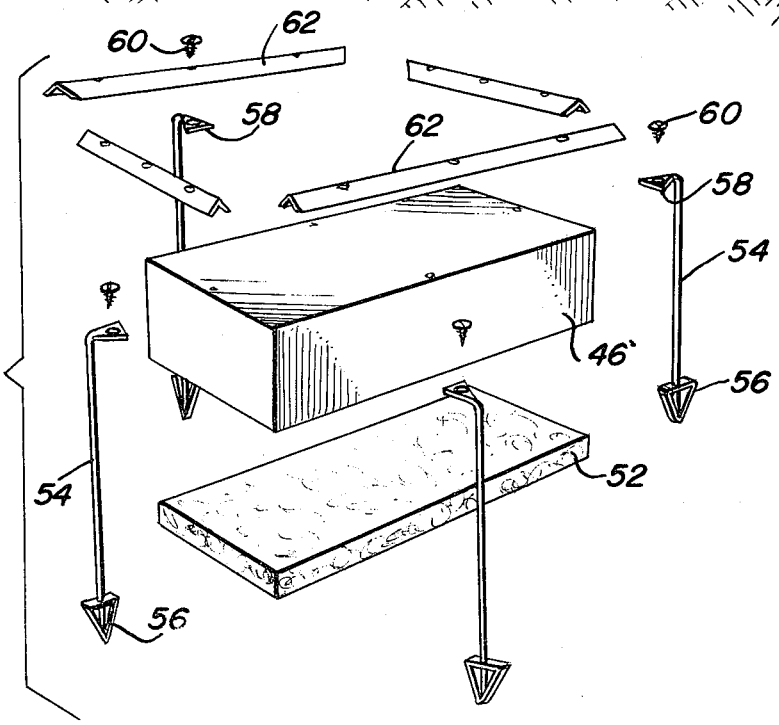
FIG. 6 is an exploded group perspective view of the embodiment of the invention illustrated in FIG. 5.

The second embodiment of the present invention is illustrated in FIGS. 4–6 and includes the same basic hardenable resin and decorative or other items embedded therein but which is a simplified construction in that the concrete container illustrated if FIGS. 1–3 has been eliminated.

In this construction, a mold 40 is provided in the form of a rectangular box which is constructed of conventional fiberglass material of a shape and size necessary to produce the permanent decoration of the present invention. The mold 40 is prepared by coating the interior surface thereof with a conventional release wax after which a gelcoat 42 is applied thereto by using conventional brush 44 or by other conventional techniques such as by spraying or the like. The gelcoat is white or any other desired color with white being preferred since it provides a constrasting background for the items, such as flowers or the like, embedded in the decoration.

After the gelcoat 42 has been applied and dried, the mold 40 is filled with a clear casting resin 46 with an appropriate quantity of catalyst being added thereto and decorative items such as flowers 48 positioned and supported therein in a conventional manner with the resin 46 reaching a relatively high temperature such as 175° F. when curing thus forming a permanent bond throughout the contacting surfaces between the gelcoat and the resin thereby providing a monolithic structure and excluding any penetration of moisture or water between the gelcoat and resin. After the resin has cured, it is only necessary to invert the mold and the hardened resin 46 with the gelcoat 42 thereon will easily come out of the mold 40.

The site of installation is then prepared by forming a cavity in the ground surfaces 50 and placing a layer of rigid form plastic material 52 therein which conforms in size to the resin 46 and may be conveniently expanded polystyrene such as "Styrofoam". Earth anchors 54 are installed at each side of the block of resin 46 with each anchor including an arrow-shaped or barbed lower anchoring end 56 and a laterally extending upper end portion 58 which is apertured and receives a central anchoring screw 60 which also extends down through the central portion of one of a plurality of angle iron members 62 which coact to define a threshold for the resin 46 that has its apex flush with the ground surface so that lawn mowing operations will not mar the surface of the resin 46 which may be provided with a clear transparent protective coating if desired. The anchoring screws 60 are screwed directly into the resin 46 or inserts may be placed in the resin 46 in communication with the top surface thereof to receive the anchoring screws when the resin 46 is formed.

With this embodiment of the invention, the concrete box or container has been eliminated and the threshold anchoring screws are received in the resin rather than into the concrete with the threshold covering the offset upper ends or lips 58 of the anchor rods 54 with one of the screws in each side of the threshold extending through the hole in the offset end or lip 58. The number of anchor rods may be varied depending upon the circumstances with the anchor rods retaining the resin block 46 in position and precluding unauthorized removal thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A permanent substantially transparent marker installed in the ground and having embedded mementos, aesthetic decorations and other items, as desired, for use as a grave marker or the like, said marker comprising:

container means;

support means within said container means, said support means being of a resilient and insulating construction;

viewing means of a substantially solid and transparent construction, said viewing means being within said container means and being substantially supported by said support means, said viewing means having at least one of said mementos, aesthetic decorations and other items embedded therein, said at least one of said mementos, aesthetic decorations and other items being viewable from a position external to said container means;

threshold means securing said viewing means within said container means, the threshold means including structural means overlying a rim portion of the container means and overlapping a peripheral portion of an upper surface of the viewing means; and fastener elements inserted into the threshold means from above, the fastener elements extending through the threshold means into the container means thereby securing the viewing means within the container means;

the threshold means being substantially flush with the ground level and protecting the upper surface of the viewing means from lawn mowing operations and the like, the support means serving to permit an expansion and contraction of said viewing means within said container means, thereby to prevent damage thereto during external environmental temperature changes, and further serving to insulate said viewing means from said external temperature changes, thereby to substantially reduce said expansion and contraction of said viewing means.

2. The marker as defined in claim 1, wherein the threshold means comprises angle-section plate having one limb extending over the container means and receiving said fastener elements, and the other limb overlapping the viewing means.

3. The marker as defined in claim 1, wherein said viewing means includes a casting resin and a catalyst in combination therewith so as to effect a desired hardening of said viewing means once said at least one of said mementos, aesthetic decorations and other items has been substantially embedded therein.

4. The marker as defined in claim 3, wherein said support means is formed from a layer of rigid foam plastic.

5. The marker as defined in claim 4, and further wherein said fastener elements comprise security means for preventing unauthorized removal thereof, so as to prevent an undesired removal of said viewing means from said container means.

6. The marker as defined in claim 5, wherein said threshold means is attached to said container means through a use of headless screws.

7. The marker as defined in claim 5, wherein said threshold means is attached to said container means by countersunk screws, and further wherein a hardening means is applied over said countersunk screws once said said screws are in position, thereby to prevent their subsequent removal.

8. A marker for a grave site comprising a rigid block of substantially transparent resin plastic having decorative items or material embedded therein and viewable from the top surface thereof, a layer of foam plastic insulation along the bottom surface of the block and engaged with the bottom of a ground cavity, said layer serving to insulate the block against environmental temperature changes and also serving to accommodate expansion and contraction of the block caused by such changes, a plurality of anchor rods extending downwardly alongside of the block and extending downwardly therebelow, each of said rods having a laterally extending upper end portion overlying an edge portion of the top surface of the block, and a threshold member mounted along the top peripheral edge of the block in overlying relation to the top ends of the anchor rods and being secured to the block with the top edge of the threshold member being flush with the ground surface to enable a lawn mower to pass thereover thereby protecting the top surface of the block from marring during mowing operations and the like.

9. The marker as defined in claim 8, wherein said anchor rods are disposed at the center of each side of the block, said threshold member including four angle iron members having their apex uppermost and the major portion of their width overlying the edge portion of the top surface of the block.

10. The marker as defined in claim 8 wherein the anchor rods have barbed lower ends.

11. The marker as defined in claim 8 including fastener elements extending through the threshold member and into the block from above for securing the threshold member to the block.

12. The marker as defined in claim 11 wherein at least some of said fastener elements extend through respective laterally extending upper end portions of the anchor rods.

* * * * *